United States Patent [19]

Kosup

[11] 4,187,482

[45] Feb. 5, 1980

[54] MULTIPLE CAPACITY CIRCUIT BREAKER

[75] Inventor: Russell R. Kosup, Laguna Niguel, Calif.

[73] Assignee: Unicorn Industries, Anaheim, Calif.

[21] Appl. No.: 867,712

[22] Filed: Jan. 9, 1978

Related U.S. Application Data

[63] Continuation-in-part of Ser. No. 752,393, Dec. 20, 1976, abandoned.

[51] Int. Cl.[2] ..... H01H 9/00

[52] U.S. Cl. ..... 335/12; 335/172

[58] Field of Search ..... 335/10, 11, 12, 172, 335/173, 132

[56] References Cited

U.S. PATENT DOCUMENTS

| | | | |
|---|---|---|---|
| 2,989,606 | 6/1961 | Walker et al. | 335/12 X |
| 3,005,066 | 10/1961 | Powell | 335/12 X |
| 3,303,441 | 2/1967 | Paton et al. | 335/12 |
| 3,826,951 | 7/1974 | Mater et al. | 335/172 X |
| 4,037,183 | 7/1977 | Gaskill | 335/172 X |
| 4,037,184 | 7/1977 | Kenipisty et al. | 335/172 X |

*Primary Examiner*—George Harris

*Attorney, Agent, or Firm*—Christie, Parker & Hale

[57] ABSTRACT

A circuit breaker including an overload trip mechanism having a current sensitive element forming a first load current conductive path. The trip mechanism is activated in response to a predetermined level of current through the trip current path. A multiple pole switch unit selectively connects a plurality of shunt load current conductive paths of various resistance values in parallel with the trip current path. The switch is operated by a cam member externally insertable into the circuit breaker in any one of a plurality of camming positions which set the switch unit to provide selected shunt current paths. Removing of the cam from the circuit breaker activates an interlock for automatically tripping the breaker. An alternative embodiment is presented wherein a contact switch unit connects, through a selectable resistance element, a shunt load current conductive path in parallel with the trip current path. The contact switch is activated by a resistance element externally insertable into the circuit breaker. Selection of the resistance element modifies the resistance of the current path in shunt with the current sensitive element to change the current rating of the breaker.

22 Claims, 17 Drawing Figures

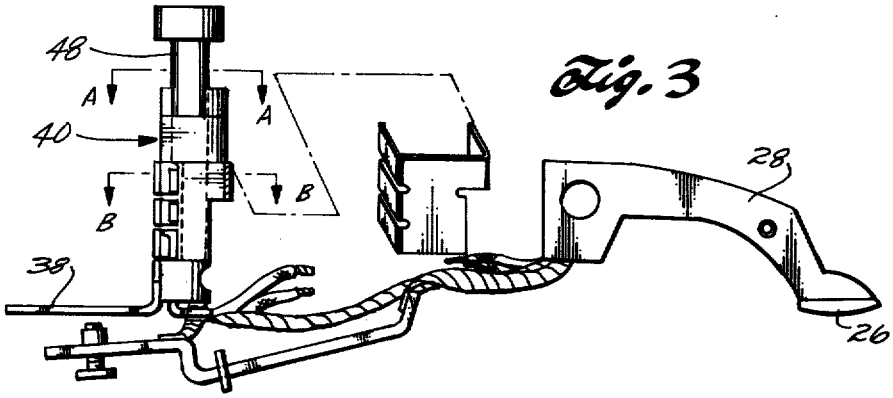
Fig. 3
Fig. 3A
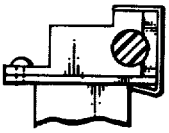
Fig. 3B
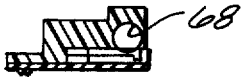
Fig. 4
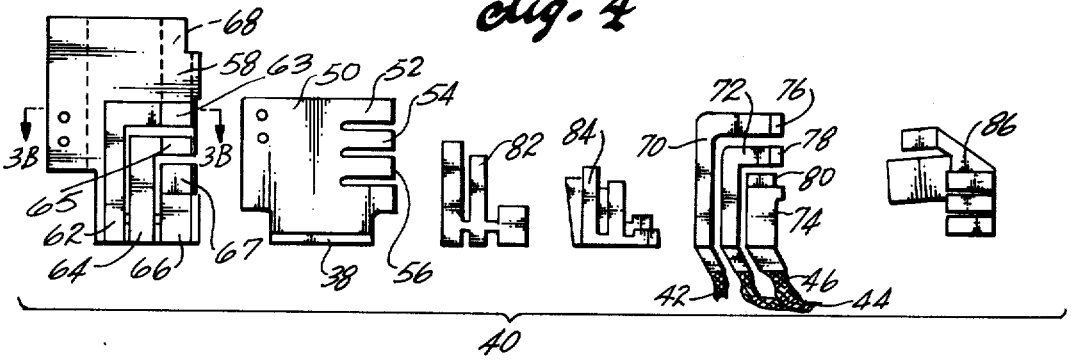
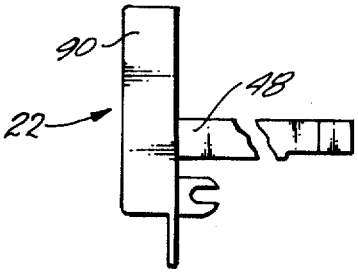
Fig. 6

Fig. 8
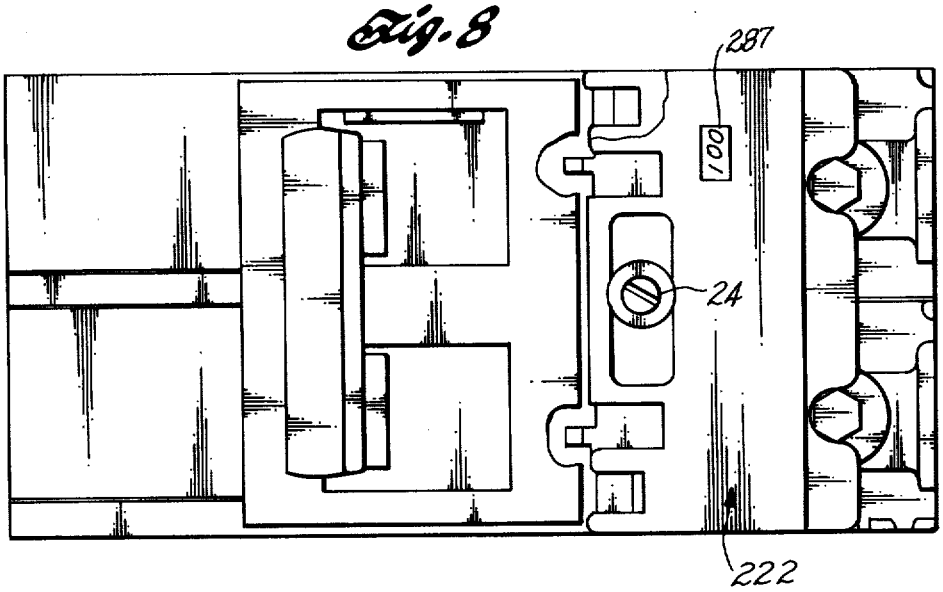
Fig. 9
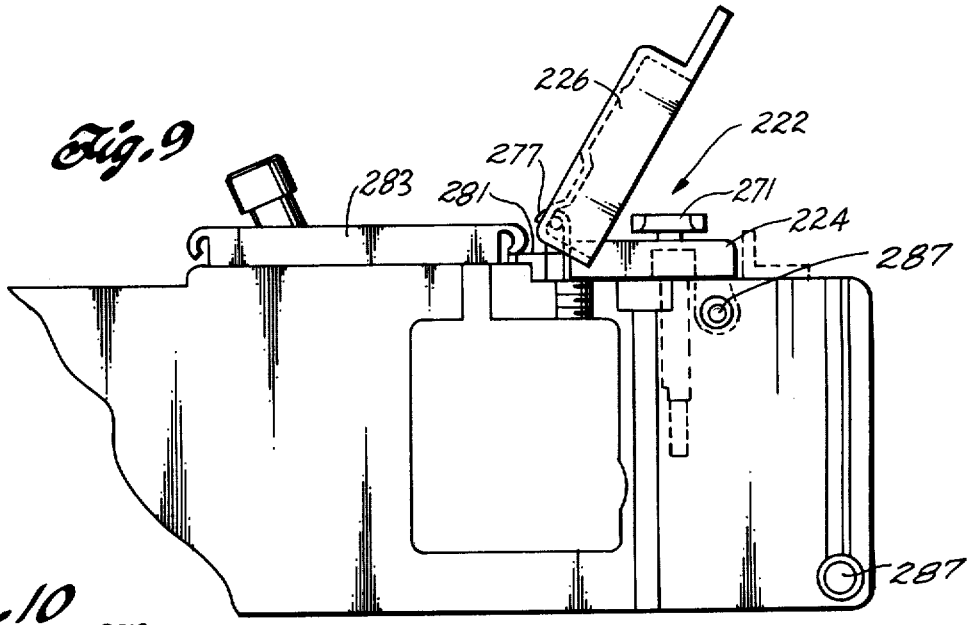
Fig. 10
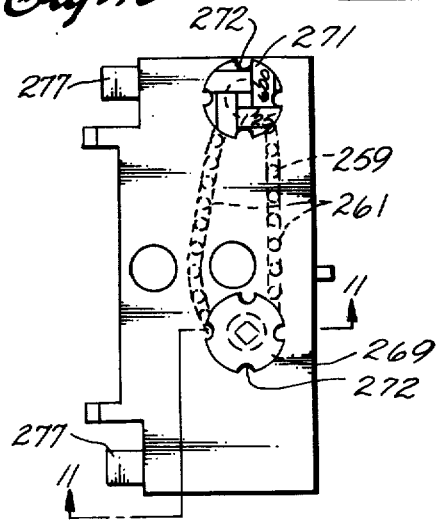
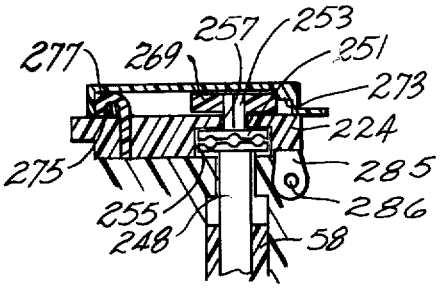
Fig. 11

Fig. 12
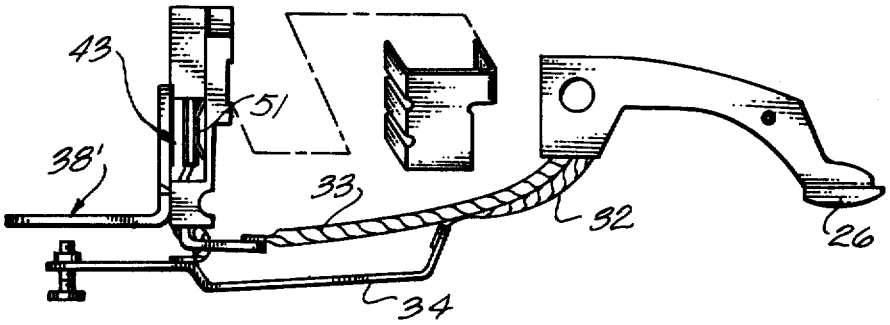
Fig. 13
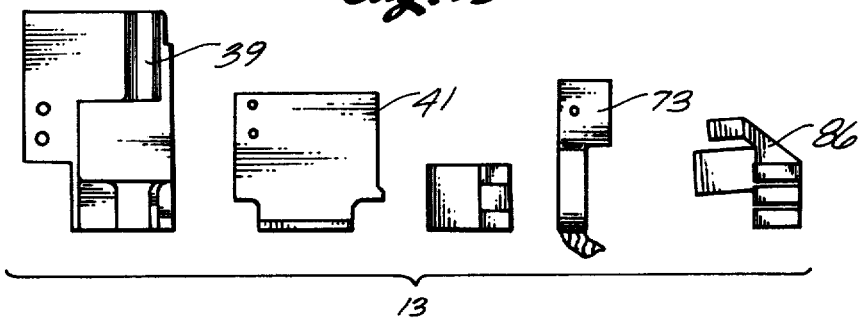
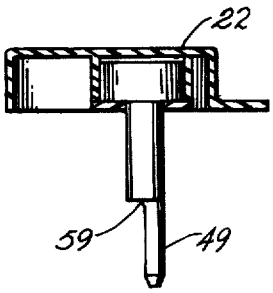
Fig. 14
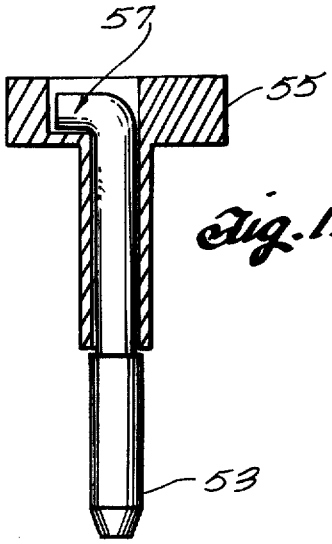
Fig. 15

MULTIPLE CAPACITY CIRCUIT BREAKER

CROSS-REFERENCES TO RELATED APPLICATIONS

This application is a continuation-in-part of application Ser. No. 752,393, filed Dec. 20, 1976, now abandoned.

BACKGROUND OF THE INVENTION

1. Field of the Invention

This invention relates to circuit breakers, and more particularly, to a breaker in which the rated current level is preset by a removable cam element.

2. Description of the Prior Art

Circuit breakers which provide over-current protection are well known. Small capacity breakers for household electrical service have substantially replaced the use of fuses. Generally such circuit breakers are built to provide a predetermined rated capacity. Breakers for individual circuits may have a rated capacity of 10 or 15 amperes. In addition, the service may have a main breaker with a predetermined capacity of, for example, 100, 150 or 200 amps., etc. The main breaker generally includes two trip units connected respectively in series with the two ungrounded lines of the standard three-conductor 220 volt service. The main breaker is a relatively expensive unit. Providing a number of different breakers to provide a range of rated capacities adds to the production and inventory cost. Therefore, it is desirable to provide a main breaker in which the rated capacity may be set at the time the breaker unit is sold to the installer or whose capacity can be changed even after installation.

While variable capacity breakers have been proposed, such known breaker units have utilized current monitoring transformers and solid-state sensors for actuating the trip mechanism when the current through the monitoring transformers reaches a predetermined level. Circuit breakers of this type are more complex and costly and so for this reason are not normally utilized in household type service.

SUMMARY OF THE INVENTION

The present invention is directed to a relatively inexpensive circuit breaker of the type commonly used as the main breaker in a household electrical service unit in which the rated capacity can be preset by a plug-in cam element made of inexpensive molded plastic material. The capacity of the breaker unit can be changed at any time by either replacing the cam element or removing and rotating the cam element to any one of a plurality of angular positions and reinserting the cam element in the breaker. An interlock arrangement insures that the cam element can not be removed without the breaker being automatically tripped. This is accomplished, in brief, by providing a breaker having a switch unit by which shunt current paths of different resistance can be selectively connected in parallel across the current path in which the current is sensed for activating the trip mechanism at a predetermined current level. The switch unit is set by a plug-in cam, the angular position of the cam when it is inserted in the breaker operating the switch unit to selectively complete one or more of the shunt current paths.

BRIEF DESCRIPTION OF THE DRAWINGS

For a more complete understanding of the invention, reference should be made to the accompanying drawings, wherein:

FIG. 3 is a view of the switch sub-assembly partially in section;

FIG. 3A is a sectional view taken on the line A—A of FIG. 3;

FIG. 3B is a sectional view taken on the line B—B of FIG. 3;

FIG. 4 is an exploded view of the switch assembly;

FIG. 6 is an end view of the plug assembly;

FIG. 8 is a top view of an alternative embodiment of the present invention;

FIG. 9 is a side view of the embodiment of FIG. 8;

FIG. 10 is a detailed top view of the plug assembly of FIG. 8;

FIG. 11 is a sectional view taken substantially on the line 11—11 of FIG. 10;

FIG. 12 is a view of an alternative contact assembly;

FIG. 13 is an exploded view of the contact assembly of FIG. 12;

FIG. 14 is a side view of the plug assembly; and

FIG. 15 is a front view of the resistance element housed in a non-conductive sleeve.

DESCRIPTION OF THE PREFERRED EMBODIMENTS

Figure 1:
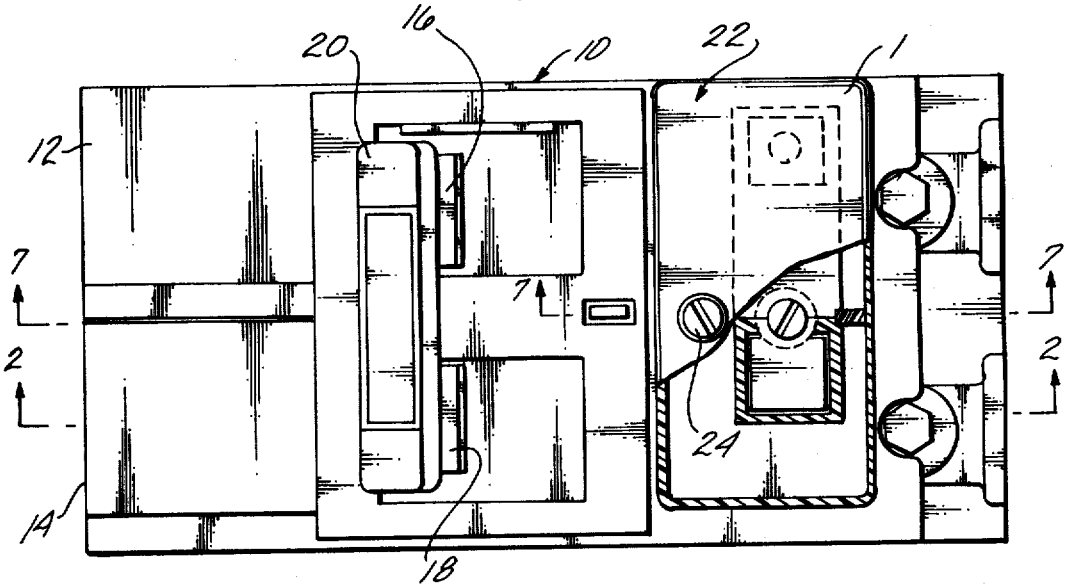
FIG. 1 is a front view of the breaker unit incorporating the features of the present invention.
Figure 2:
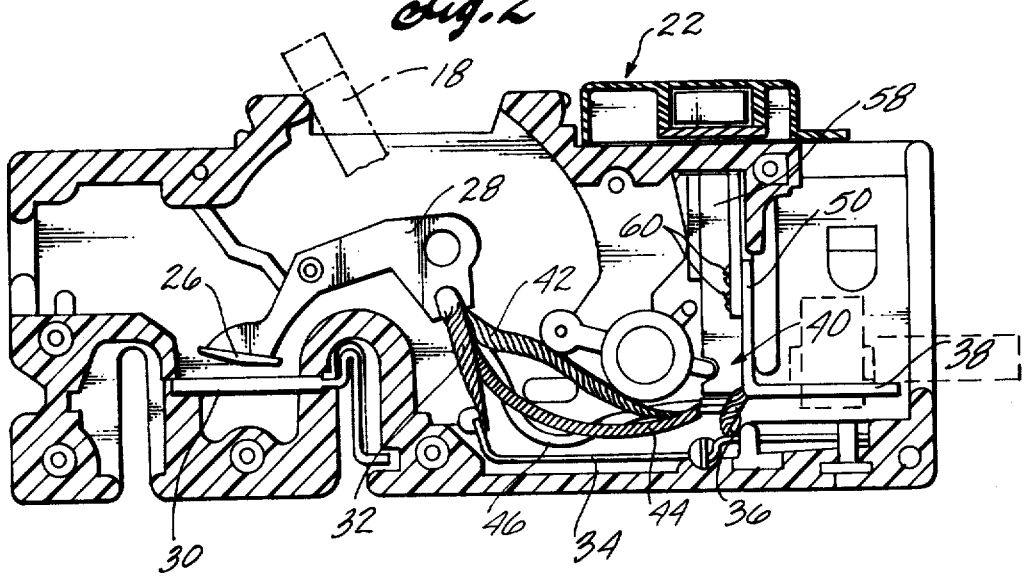
FIG. 2 is a sectional view taken on the line 2—2 of FIG. 1 with the trip mechanism removed.

Referring to FIG. 1, there is shown a circuit breaker assembly 10 which is assembled by clamping together two individual circuit breaker units 12 and 14 in side-by-side relationship. Each circuit breaker unit includes a manually-operated on-off handle, indicated respectively at 16 and 18. The handles are linked together by a connector bar 20 so as to operate in unison. The breaker assembly 10 is preferably of the type described in more detail in my copending application Ser. No. 532,938, filed Oct. 16, 1974, now U.S. Pat. No. 3,986,155 and assigned to the same assignee as the present application. The trip capacity of the breaker units is controlled by a plug-in assembly indicated generally at 22, which plugs into the front of the circuit breaker assembly 10 and is held in place by a screw 24. The screw 24, when loosened to remove the plug assembly 22, automatically trips both breaker units in a manner which is hereinafter described in more detail in connection with FIG. 7.

The trip mechanism (not shown) of the circuit breaker is of conventional design such as described, for example, in U.S. Pat. Nos. 2,692,926 and 2,878,332. The trip mechanism operates a movable contact 26 supported by a pivoted switch arm 28 for movement in and out of electrical contact with a fixed contact 30. When the contacts 26 and 30 are closed, a current path is provided through the switch arm 28, flexible braided copper line 32, through a bimetallic element 34, a flexible braided copper line 36, and output terminal 38. In the event of an overload, heating of the bimetallic element 34 actuates the trip mechanism, thereby moving the contact 26 away from the fixed contact 30 to break the circuit. The rating of the breaker is determined by the resistance of the current path through the bimetallic element 34 and the temperature rise required to operate the trip mechanism. It is standard practice to increase the overload rating of a circuit breaker by shunting a portion of the load current around the bimetallic element 34. For example, if half the current is directed through a shunt current path, the current rating at which the breaker trips is doubled.

The present invention is directed to a multiple capacity breaker in which a low resistance switching unit 40 connects one or more separate conductors 42, 44, and 46, which are connected at one end to a common terminal formed by the switch arm 28, to the output terminal 38. The switch assembly 40 selectively thus provides one or more of the current shunt paths bypassing the bimetallic element 34 to the output terminal 38. The switch assembly 40 is set by a camming rod 48 projecting from the plug-in assembly 22 for each breaker unit.

The switch assembly 40 is shown in detail in FIGS. 3 and 4. The output terminal 38 is an L-shaped bracket, the one leg of which is indicated at 50. The leg 50 is slit along one edge to form three contact fingers 52, 54, and 56. The leg 50 of the bracket is secured to a supporting block 58, molded of an insulating material such as phenolic, by means of screws 60. The surface of the block 58 which is in contact with the leg 50 is formed with three channels 62, 64 and 66. The channels 62 and 64 are L-shaped, as shown in FIG. 4. A hole 68 drilled in from the upper end of the block, as shown in FIG. 3A. The hole 68 intersects the channels 62, 64, and 66 to form substantially square openings 63, 65 and 67. Inserted in the channels 62, 64 and 66 are three switch contact elements 70, 72 and 74, to which the conductors 42, 44 and 46, respectively, are connected. The outer end of the contact elements are provided with projecting contacts 76, 78 and 80, respectively.

With the contact elements 70, 72 and 74 inserted in the channels 62, 64 and 66, a thin sheet of insulating material 82 is placed on top of the contact elements to insulate the contact elements from a U-shaped spring member 84. The contact elements, insulator, and spring member are clamped in place by the leg 50 of the L-shaped output terminal member 38. In addition to screws 60, the assembly is further secured by a U-shaped spring clip 86 which acts to clamp the block 58 and the contact fingers 52, 54 and 56 securely together. The spring 84, however, acts to urge the contacts 76, 78 and 80 away from the surface of the contact fingers 52, 54 and 56 to provide a normally open gap which breaks the current path through any one of the conductors 42, 44 and 46 and the output terminal 38.

With the switch assembly 40 in the condition in each of the breaker units 12 and 14, shown in FIG. 3, the sole current path to the breaker is through the bimetallic element 34, since there is no current path through the normally open contacts of the switch assembly 40. Thus the breaker units provide the minimum current rating for which the breakers are designed. To set the ratings of the breakers, the plug assembly 22 with its two camming rods 48 is inserted into the front of the breaker assembly. The camming rods selectively engage selected ones of the contact elements 70, 72 and 74 through the openings 63, 65 and 67, respectively. This sets the switch assembly 40 in each of the breaker units to provide a current path through none, one or more of the shunt conductors 42, 44 or 46, according to the desired rating of the breaker assembly.

Figure 5:
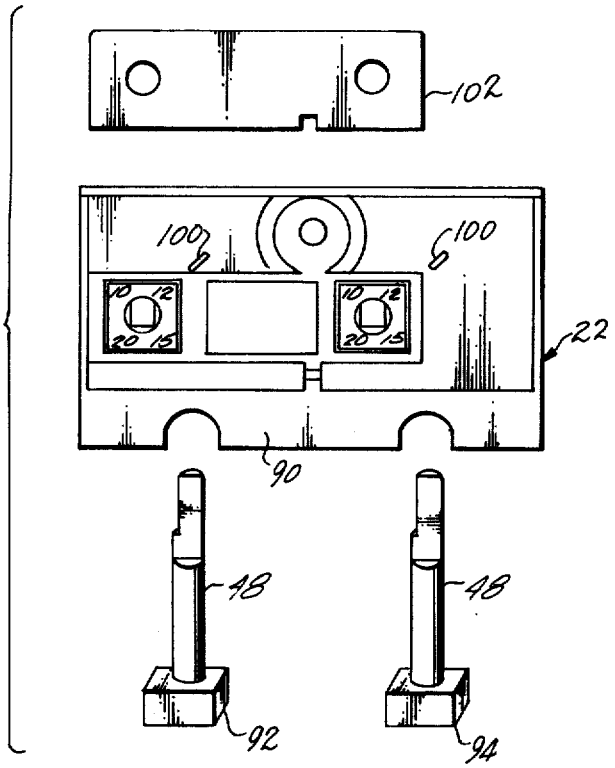
FIG. 5 is an exploded view of the plug assembly.

The plug assembly 22, shown in detail in FIG. 5, includes a molded cap 90. The bottom of the cap is molded with a pair of spaced square recesses for receiving the square heads 92 and 94 of a pair of camming rods 48. With the heads 92 and 94 inserted in the cap, the camming rods 48 project perpendicularly from the bottom of the plug assembly 22 in position to be inserted into the holes 68 of the switch assemblies 40 in the respective breaker units 12 and 14. Because of the square shaped heads, the camming rods 48 can be assembled in any one of four angular positions about their longitudinal axes. The angular position determines the resulting rated capacity of the breaker assembly when the plug assembly 22 is inserted in place. A rating number is inscribed or otherwise formed on each of the four corners of the square, for example, the numbers 10, 12, 15 and 20 corresponding to ratings of 100, 125, 150 and 200 amperes. The heads 92 and 94 are inserted in the cap with the appropriate rating number aligned with an indexing element 100. The heads are then locked in place by a plate 102 which has a pair of openings that fit over the projecting camming rods 48. The plate 102 is cemented in place to complete the plug assembly.

When the plug assembly 22 is inserted in place in the breaker units 10 and 12, the camming rods fit into the holes 68 in the respective switch assemblies 40. The camming rods, when inserted, act to wedge the contacts 76, 78 and/or 80 toward the contact fingers 52, 54 and 56, respectively. The camming rods are formed with three flat surfaces of different lengths extending parallel to three of the sides of the associated square heads. It will be seen that the outer circumference of the camming rod forces the contacts into a closed condition, but where the outer circumference is relieved by a flat surface, the effect of the flat surface when positioned opposite one of the contacts 76, 78 and 80 is to open the electrical contact with the associated one of the fingers 52, 54 or 56 under the action of the spring 84. By making the length of the reach of the three flat surfaces of the camming rod of differing lengths, none, 1, 2 or all three of the contacts may be wedged against the contact fingers 52, 54 and 56 when the plug assembly is inserted, depending upon which of the four rating positions the camming rods are positioned in. Thus, it will be seen that plug assemblies 22 can be fabricated to provide any one of four possible ratings for the circuit breaker assembly. Merely by substituting one plug assembly for another, the rating of the breaker can be changed.

Figure 7:
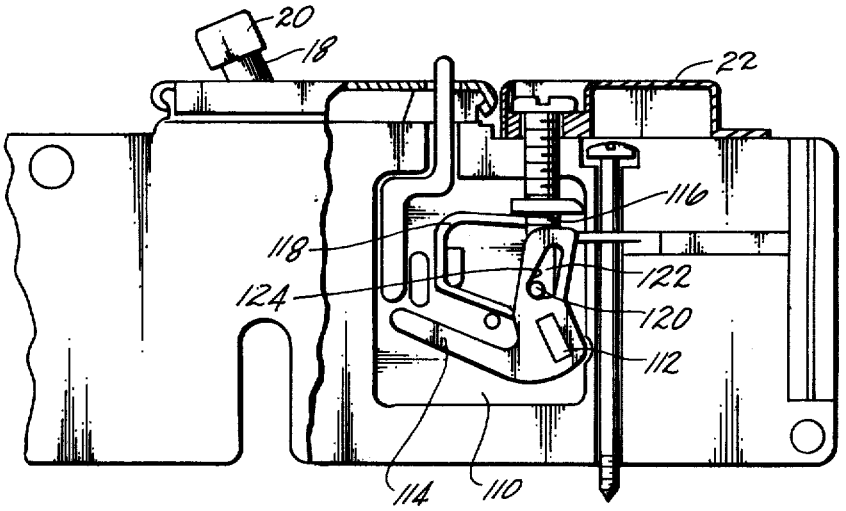
FIG. 7 is a side view showing the interlock for tripping the breakers when the plug assembly is removed.

An interlock system, such as the external trip mechanism described in copending application Ser. No. 532,938, filed Dec. 16, 1974, entitled "Circuit Breaker with Remote Trip Mechanism", by the same inventor as the present invention, is shown in FIG. 7. The screw 24 which holds the plug assembly 22 in place, extends into a recessed region 110 forming a chamber between the two breaker units 12 and 14. A trip bar 112 extends into and between the two breaker units 12 and 14 through this chamber for linking the two trip mechanisms. A trip lever 114 when moved in a counterclockwise direction, as viewed in FIG. 7 rotates the trip bar 112 and trips both breaker units. The screw 24 pushes downwardly on a plunger 116 against the action of a spring 118. The plunger 116 has a pin 120 which projects into an opening 122 in one arm of the lever 114. When the screw 24 is removed to replace the plug assembly 22, the spring 118 urges the plunger 116 upwardly, causing the pin 120 to move along an edge 124 in the opening 122. The pin thereby wedges the trip lever 114 in the counterclockwise direction, causing both breaker units to be tripped. When a new plug assembly 22 is inserted in position, the breaker units are reset by manually operating the connector bar 20 on the breaker.

Rather than the plug assembly 22 being a preassembled unit which must be replaced to change the capacity of the breakers, an alternative arrangement is shown in FIGS. 8–11 wherein the plug assembly is permanently stalled and made adjustable to change the capacity of the breaker. The adjustable plug assembly is indicated generally at 222. The adjustable plug assembly includes a base 224 molded from a suitable insulating material to which is attached a hinged molded plastic cover 226. The base 224 has a pair of camming rods 248 projecting from the bottom which plug into the circuit breaker assembly in the same manner as the camming rods 48 of the plug-in assembly 22 described above. However, as hereinafter explained in detail, the camming rods are made rotatable about their longitudinal axes and are linked together so that they may be simultaneously rotated into any one of four angular positions. To this end, the upper ends of the camming rods 248 are each molded with an integral sprocket 251 and a square stem 253. Sprocket 251 is positioned in a recess 255 formed in the base 224, the stem 253 extending upwardly through an opening 257. The sprockets 251 on the two camming rods are linked together by a drive chain 259 which passes through guides 261 between the two sprockets formed in the base 224. The camming rods are held in place by retaining members 269 and 271, which are press fitted on the square stems 253. The retaining members are each provided with four detent notches 272 which are engaged by detents 273 integrally molded on the underside of the lid 226. Thus, when the lid is closed, the retaining members 269 and 271 are locked in position, preventing accidental rotation of the camming rods 248.

The lid 226 is hinged to the base 224 by means of integrally molded hinge pins 275 which are engaged by hinge hooks 277, extending from the base 224. The base 224 is held by retaining lugs 281 which fit under escutcheon plate 283 attached to the front of the circuit breakers. In addition, an integral lug 285 is provided extending from the bottom of the base 224 and having a hole 286 therein through which passes one of the rivets 287 that secure the circuit breaker units together.

The screw 24 extends through an opening in the lid 226 thereby providing an interlock which insures that the lid 226 cannot be opened without first tripping the breakers. With the lid open, the retainers 269 and 271 can be rotated to any one of the four positions for changing the capacity of the breakers. The retaining member 271 has the capacity values printed on the top surface in position to be visible through a window or opening 287 in the top of the lid, thereby providing an indication on the front of the breaker assembly of the capacity setting.

An alternative embodiment in the present invention, shown in FIGS. 12–15, is directed to a multiple capacity breaker in which a low electrical resistance element 49 electrically connects, by means of contact assembly 43, the switch arm 28 through single shunt conductor 33 to output terminal 38'. Inserting selectable value resistance elements 49 into contact assembly 43, as will be shown, provides an externally adjustable resistance path that shunts the bi-metallic element 34.

The contact assembly is shown in detail in FIGS. 12 and 13. The modified output terminal 38' is solid along both edges and has an electrical contact surface 39. Conductors 42, 44 and 46 are replaced by a single low resistance conductor 33 that provides an electrical path between switch arm 28 and a contact element 73.

The plug-in resistance element 49, shown in detail in FIGS. 14 and 15, includes a molded plastic housing 55 in which the resistance element is secured by an angular bend 57. The molded housing is made the same shape as the camming rod 48, described above, and is secured in a fixed position in the plug assembly 22 in the same manner but with a single orientation. The offset at 59 in resistance element 49 is merely to provide the proper mechanical alignment between the removable plug assembly 22 and the contact assembly 43. Metals of selectable resistivity are used in forming the resistance elements 49 thereby providing controlled electrical resistance through contact assembly 43. Examples of such metals are copper, aluminum, phosphorus bronze and inconel. When plug assembly 22 is inserted in place in the breaker units 10 and 12, the resistance elements 49 fit into the holes 68 in the respective contact assemblies 43. The resistance element acts as a wedge jointly engaging and thereby creating an electrical connection between contact surface 39 and contact 73. Firm engagement pressure between contact surface 39, contact 73 and resistance element 49 is provided by pressure spring 51. The electrical resistance at contact assembly 43 determines the resulting rated capacity of the breaker assembly by providing a selectable shunt path resistance across bi-metallic element 34. Ratings of 100, 125, 150 and 200 amperes are available depending upon selection of the appropriate plug assembly.

What is claimed is:

1. A circuit breaker comprising:

a housing, an overload current responsive trip mechanism mounted in the housing, the trip mechanism including a current sensitive element forming a first load current conductive path for activating the trip mechanism in response to the level of current through said first path, and switch means forming at least one shunt load current conductive path in parallel with said first path, the switch means selectively opening or closing the current path in shunt with the current sensitive element to change the current rating of the circuit breaker.

2. The apparatus of claim 1 wherein the switch means includes a plurality of switches, each switch including a fixed contact and movable contact, and cam means removably inserted in the housing and engaging the moving contacts for selectively moving one or more of said moving contacts into engagement with the associated fixed contact to complete one or more of said current paths.

3. The apparatus of claim 2 further including interlock means for tripping said overload trip mechanism when the cam means is removed from the housing.

4. The apparatus of claim 2 wherein the fixed contacts of the switches comprise a conductive plate having parallel slits along one edge forming a plurality of fingers forming the fixed contacts.

5. The apparatus of claim 4 wherein the moving contacts comprise a plurality of separate conductor arms, an insulating block, the conductive plate being secured to the block with the conductor arms mounted between the plate the block, spring means normally urging the arms away from the plate, the cam means comprising a non-conductive rod inserted in a bore in the block, the surface of the rod when inserted in the base engaging the arms and selectively wedging the arms toward and into contact with the plate against the urging of the spring means.

6. The apparatus of claim 5 wherein the rod is rotatable in the bore, the surface of the rod having flat areas formed thereon, a flat area, when rotated by the rod to a position adjacent a contact arm, permitting the arm to move away and out of contact with said plate.

7. The apparatus of claim 6 further including means for securing the rod in a predetermined angular position when the rod is inserted in the bore.

8. The apparatus of claim 1 wherein the switch means includes at least one pair of contacts and a removable plug insertable between the pairs of contacts for making or breaking a current path between the pair of contacts.

9. The apparatus of claim 8 wherein the removable plug is a non-conductive cam element for moving the contacts in and out of electrical contact to close or open the shunt current path.

10. The apparatus of claim 8 where the removable plug is a low resistance element for inserting a predetermined current resistance between the switch contacts.

11. In a circuit breaker of the type having a switch for intercepting load current between two terminals of the breaker and a resettable trip mechanism including a current sensing element responsive to the level of current through the sensing element for opening the switch and interrupting the load current when the current through the sensing element reads a predetermined level, apparatus for adjusting the overload rating of the breaker comprising: means providing a plurality of low resistance current conductive shunt paths connected in parallel with the sensing element for shunting a portion of the load current past the sensing element, and switching means connected in series with each of said shunt paths for selectively interrupting current flow through any of said shunt paths.

12. The apparatus of claim 11 wherein the switch means includes cam means for activating the switching means to selectively open or close respective ones of said shunt paths in response to the setting of the cam means.

13. The apparatus of claim 12 wherein the cam means includes a removable plug inserted in the switching means.

14. The apparatus of claim 13 wherein the plug is insertable in the switching means in any one of a plurality of positions, each position selecting a different setting of the switching means.

15. The apparatus of claim 13 wherein the plug is rotatable when inserted in the switching means for selectively setting the switch means.

16. The apparatus of claim 15 further including means for releasably securing the plug against rotation, and means for tripping the breaker when said means is released.

17. A circuit breaker comprising:

a housing, an overload current responsive trip mechanism mounted in the housing, the trip mechanism including a current sensitive element forming a first load current conductive path, and contact means for selectively opening or closing a current path in shunt with the current sensitive element to change the current rating of the circuit breaker.

18. The apparatus of claim 17 wherein the contact means includes a pair of adjacent relatively movable electrically conductive contacts, and an electrical resistance means removably inserted into the housing and between the contacts for jointly engaging the contacts to change the resistance to current flow between the contacts.

19. The apparatus of claim 18 wherein said electrical resistance means removably inserted into the housing includes a plug-in element.

20. The apparatus of claim 18 wherein the electrical resistance means includes an electrical conducting element of selectable resistivity to change the resistance of said shunt current path thereby changing the current rating of the breaker.

21. The apparatus of claim 19 wherein the plug-in element is a non-conductive cam member for wedging one contact away from and out of direct electrical contact with the other contact.

22. The apparatus of claim 20 wherein the plug-in element is an electrically conductive resistance element for wedging between the two contacts to provide a controlled resistance current path between the contacts.

* * * * *